US010876435B2

(12) United States Patent
Matsumoto et al.

(10) Patent No.: US 10,876,435 B2
(45) Date of Patent: Dec. 29, 2020

(54) VARIABLE VALVE TIMING DEVICE AND ASSEMBLY METHOD OF VARIABLE VALVE TIMING DEVICE

(71) Applicant: Mitsubishi Electric Corporation, Tokyo (JP)

(72) Inventors: Takuhiro Matsumoto, Tokyo (JP); Hirofumi Hase, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/346,961

(22) PCT Filed: Jan. 5, 2017

(86) PCT No.: PCT/JP2017/000113
§ 371 (c)(1),
(2) Date: May 2, 2019

(87) PCT Pub. No.: WO2018/127952
PCT Pub. Date: Jul. 12, 2018

(65) Prior Publication Data
US 2020/0056518 A1 Feb. 20, 2020

(51) Int. Cl.
*F01L 1/344* (2006.01)
*F01L 31/12* (2006.01)

(52) U.S. Cl.
CPC ..... *F01L 1/344* (2013.01); *F01L 1/3442* (2013.01); *F01L 31/12* (2013.01); *F01L 2303/01* (2020.05)

(58) Field of Classification Search
CPC . F01L 1/3442; F01L 2103/01; F01L 2103/02; F01L 2103/00; F01L 2101/00; F01L 2303/01; F01L 2303/02; Y10T 29/53
USPC ..... 123/90.17, 90.15
See application file for complete search history.

(56) References Cited

U.S. PATENT DOCUMENTS 7,296,547 B2 * 11/2007 Ottersbach ..... F01L 1/022 123/90.15
2006/0086331 A1 4/2006 Ottersbach et al.
2008/0236528 A1 * 10/2008 Hertrich ..... F01L 1/3442 123/90.17

(Continued)

FOREIGN PATENT DOCUMENTS

DE 10 2004 035 077 A1 2/2006
DE 10 2004 051 424 A1 2/2006

(Continued)

OTHER PUBLICATIONS

International Search Report issued in PCT/JP2017/000113 (PCT/ISA/210), dated Feb. 7, 2017.

(Continued)

*Primary Examiner* — Patrick Hamo
*Assistant Examiner* — Wesley G Harris
(74) *Attorney, Agent, or Firm* — Birch, Stewart, Kolasch & Birch, LLP

(57) ABSTRACT

A case for rotating integrally with a crankshaft of an engine; a rotor housed in the case, to be rotated integrally with a camshaft of the engine by fastening the rotor coaxially to the camshaft with a center bolt; and a groove provided around an axis of the rotor on an opposite side of the rotor to the camshaft, and having an inner wall intersecting a rotation direction of the rotor are provided.

4 Claims, 6 Drawing Sheets

(56) References Cited

U.S. PATENT DOCUMENTS

2012/0298058 A1* 11/2012 Fischer ..... F01L 1/3442
123/90.15

FOREIGN PATENT DOCUMENTS

| | | | | | |
|---|---|---|---|---|---|
| DE | 102008049107 | A1 * | 4/2010 | ..... | F16D 3/10 |
| JP | 10317923 | A * | 12/1998 | ..... | F01L 1/3442 |
| JP | 2014-139422 | A | 7/2014 | | |
| WO | WO-2009027167 | A1 * | 3/2009 | ..... | F01L 1/3442 |
| WO | WO-2017159121 | A1 * | 9/2017 | ..... | F01L 1/3442 |

OTHER PUBLICATIONS

Office Action dated Sep. 2, 2020 in corresponding Chinese Application No. 201780079865.3.

* cited by examiner

VARIABLE VALVE TIMING DEVICE AND ASSEMBLY METHOD OF VARIABLE VALVE TIMING DEVICE

TECHNICAL FIELD

The present invention relates to a variable valve timing device (hereinafter referred to as a VVT device) and an assembly method of the VVT device.

BACKGROUND ART

A VVT device is a device that variably controls opening and closing timing of an intake valve or an exhaust valve of an engine of a vehicle, and is fastened to a camshaft by a bolt (see, for example, Patent Literature 1).

Fastening torque generated when the VVT device is assembled to the camshaft by the bolt is received by the camshaft if the camshaft is held.

If the camshaft cannot be held, when the VVT device is assembled to the camshaft, a rotor and the camshaft are interlocked, so that rotation of the camshaft is fixed via the rotor.

For example, a projection provided on a jig is inserted into a groove provided around an axis of the rotor to fix rotation of the rotor and the camshaft, and in this state, the VVT device is fastened to the camshaft using the bolt. A load of fastening torque generated at this time is applied to a contact portion between the projection of the jig and an inner wall of the groove of the rotor.

CITATION LIST

Patent Literatures

Patent Literature 1: JP 2014-139422 A

SUMMARY OF INVENTION

Technical Problem

In the conventional VVT device, the load of the fastening torque concentrates on the contact portion between the projection of the jig and the inner wall of the groove of the rotor, so there is a possibility that the groove or the jig may be damaged by the excessive load.

In order to prevent the concentration of the load of the fastening torque, it is conceivable to lengthen the projection of the jig and deepen the groove of the rotor to increase a contact area between them.

However, with this configuration, a size of the groove increases in an axial direction of the rotor, a size of the rotor is thereby increased, which hampers downsizing or weight reduction of the VVT device.

It is an object of the present invention to provide a VVT device and an assembly method of the VVT device capable of suppressing stress concentration caused by torque generated by assembling the VVT device.

Solution to Problem

A VVT device according to the present invention includes: a case for rotating integrally with a crankshaft of an engine; a rotor housed in the case, to be rotated integrally with a camshaft of the engine by fastening the rotor coaxially to the camshaft with a center bolt; and at least one torque receiving part provided around an axis of the rotor on an opposite side of the rotor to the camshaft, and having a flat surface intersecting a rotation direction of the rotor. The at least one torque receiving part is a groove or a projection, the rotor has a recess in a center of a boss, the groove is provided on a bottom surface of the recess, and an inner wall on a radially outer side of the groove is continuous with an inner wall of the recess.

Advantageous Effects of Invention

According to the present invention, by providing the torque receiving unit having the flat surface in the rotation direction of the rotor, a load of fastening torque generated by tightening a bolt is applied to a portion where the flat surface and a part of a jig are in surface contact with each other. Consequently, it is possible to suppress concentration of stress due to the fastening torque.

DESCRIPTION OF EMBODIMENTS

Hereinafter, in order to explain the present invention in more detail, embodiments for carrying out the present invention will be described with reference to the accompanying drawings.

First Embodiment

Figure 1:
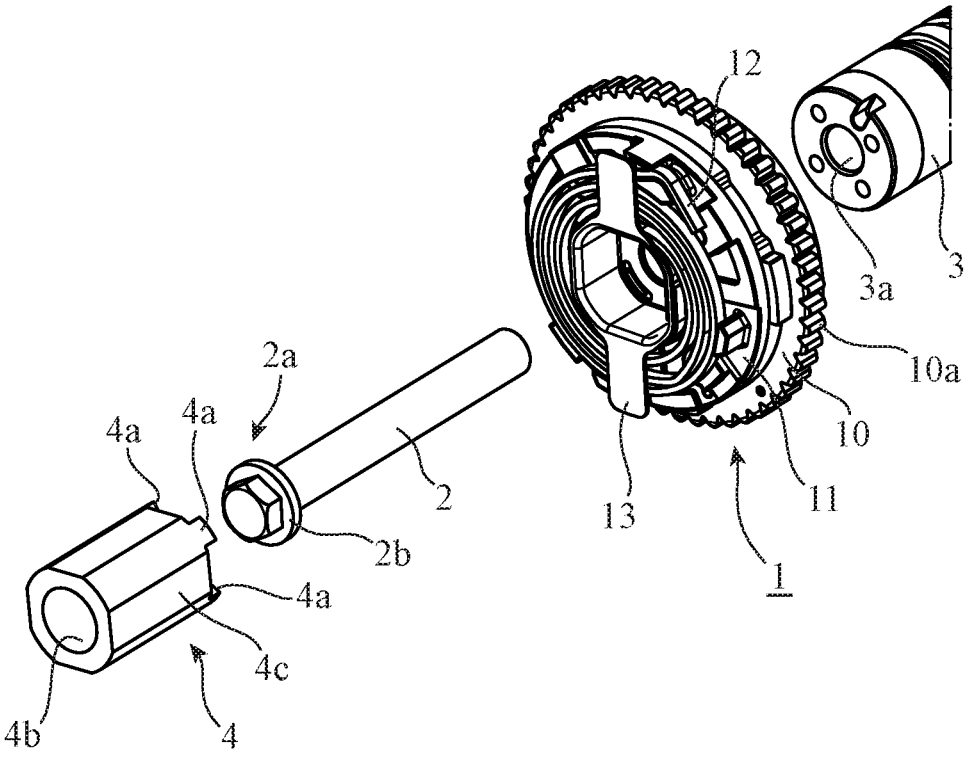
FIG. 1 is an exploded perspective view showing an assembling structure of a VVT device according to a first embodiment of the present invention to a camshaft.
Figure 2:
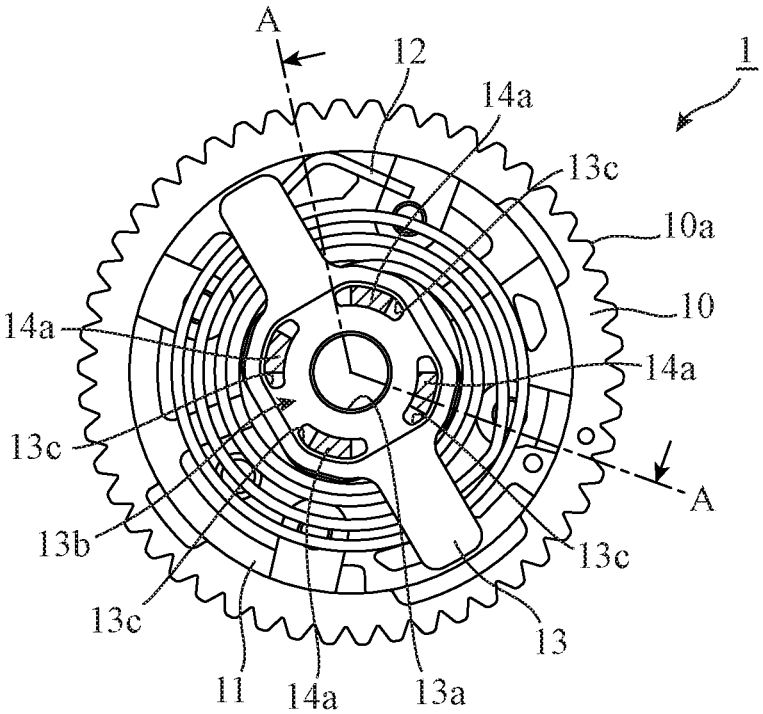
FIG. 2 is a front view showing the VVT device according to the first embodiment.
Figure 3:
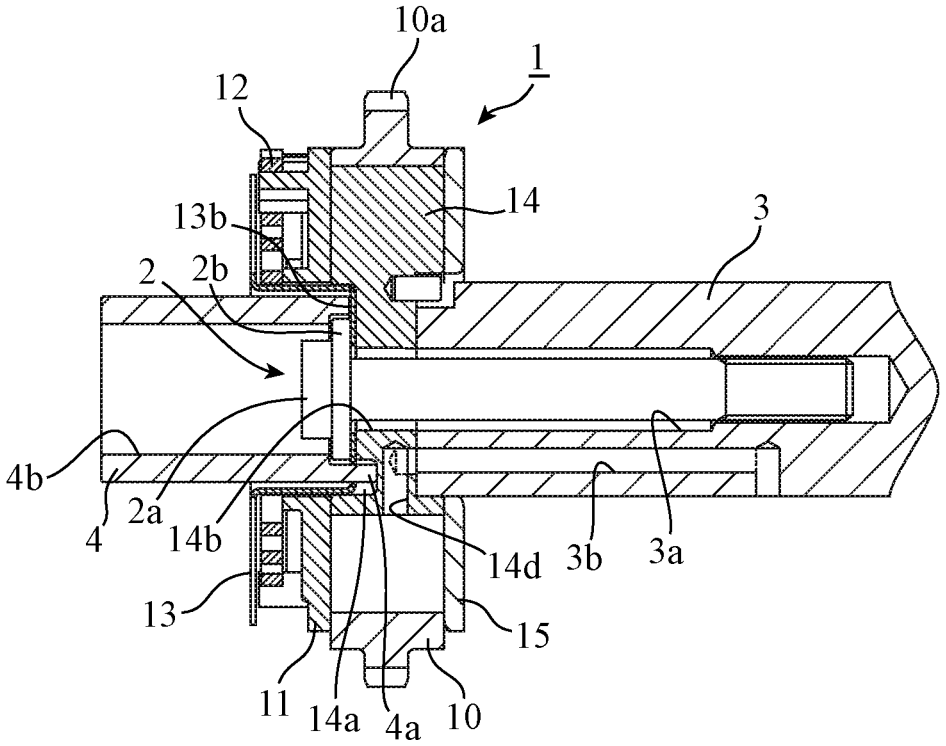
FIG. 3 is a sectional arrow view showing a state in which the VVT device according to the first embodiment is cut off along line A-A in FIG. 2.

FIG. 1 is an exploded perspective view showing an assembling structure of a VVT device 1 according to a first embodiment of the present invention to a camshaft 3. FIG. 2 is a front view showing the VVT device 1. FIG. 3 is a sectional arrow view showing a state in which the VVT device 1 is cut off along line A-A in FIG. 2.

As shown in FIG. 1, the VVT device 1 is fastened coaxially with the camshaft 3 using a center bolt 2. A jig 4 is a jig for fixing rotation of a rotor 14 and the camshaft 3 when fastening the VVT device 1 to the camshaft 3 with the center bolt 2. The jig 4 is a tubular member and has a plurality of projections 4*a* that protrudes in an axial direction from one end.

The VVT device 1 mainly includes a case 10, a cover 11, a spiral spring 12, a spring holder 13, the rotor 14, and a housing 15.

The case 10 has a chain sprocket 10*a* for transmitting driving force from a crankshaft of an engine (not shown) to the camshaft 3, and transmits rotational driving force of the engine to the VVT device 1 via this chain sprocket 10*a*. The rotor 14 and the camshaft 3 are integrally rotated by the rotational driving force of the engine to change a rotational phase difference between the camshaft 3 and the crankshaft.

The spiral spring 12 is disposed coaxially with the rotor 14 by the spring holder 13, and both ends of the spiral spring 12 are locked on the cover 11. As the spiral spring 12 is twisted and deformed via the spring holder 13, assist torque for assisting the rotation of the rotor 14 is generated.

The spring holder 13 is a holder that holds the spiral spring 12 on the cover 11. As shown in FIG. 2, a center hole 13*a* through which the center bolt 2 passes and a long hole 13*c* through which the projection 4*a* of the jig 4 passes are formed at a bottom 13*b* of the spring holder 13. The long hole 13*c* is an arcuate through hole centered on an axis of the rotor 14.

The center bolt 2 has a flange 2*b* projecting radially outward from a head 2*a*. As shown in FIG. 3, the bottom 13*b* of the spring holder 13 is fastened to the rotor 14 by the center bolt 2 in a state that the bottom 13*b* is sandwiched between the flange 2*b* of the center bolt 2 and the rotor 14. The assist torque generated by the spiral spring 12 is transmitted to the rotor 14 by the spring holder 13 fastened to the rotor 14.

The rotor 14 is housed in a space in which the cover 11 and the housing 15 are assembled to the case 10, and is fastened to one end of the camshaft 3 by the center bolt 2.

As shown in FIG. 2, a plurality of grooves 14*a* is formed around the axis of the rotor 14 on a side opposite to the camshaft 3. Each of the plurality of grooves 14*a* has an inner wall that is a flat surface in a rotation direction of the rotor 14, and functions as a torque receiving unit that receives fastening torque or loosening torque of the center bolt 2.

Next, a procedure for assembling the VVT device 1 to the camshaft 3 will be described.

After the end of the camshaft 3 is fitted to the housing 15 side of the VVT device 1, the center bolt 2 is passed through a center hole 14*b* of the rotor 14, and the jig 4 is mounted on the VVT device 1.

When the jig 4 is mounted on the VVT device 1, each of the plurality of projections 4*a* is inserted into the groove 14*a* of the rotor 14 through the long hole 13*c* of the spring holder 13, and the head 2*a* of the center bolt 2 enters a through hole 4*b*.

By fixing the jig 4 with a tool or the like in this state, a contact portion between the projection 4*a* and the groove 14*a* serves as a rotation stop of the rotor 14, and rotation of the rotor 14 and the camshaft 3 is fixed.

After the jig 4 is fixed in this manner, the center bolt 2 is screwed into a female screw hole 3*a* of the camshaft 3, so that the VVT device 1 is fastened to the camshaft 3. Thereafter, the jig 4 is removed from the VVT device 1.

Figure 4A:
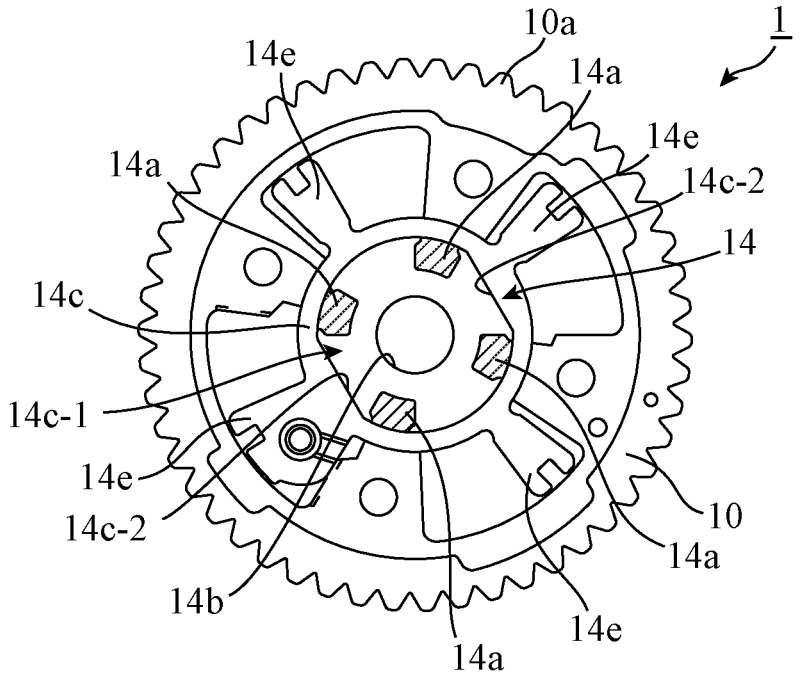
FIG. 4A is a view showing the inside of the VVT device according to the first embodiment.
Figure 4B:
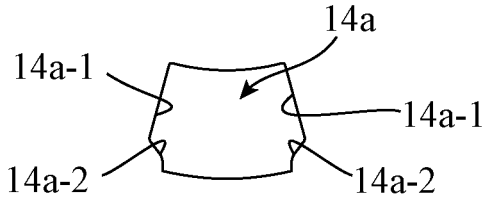
FIG. 4B is a view showing a groove of a rotor in the first embodiment.
Figure 4C:
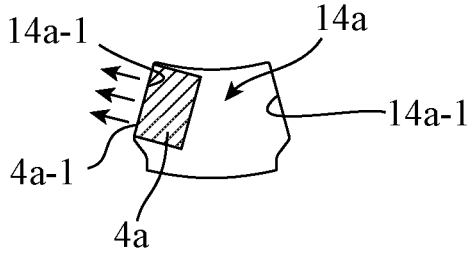
FIG. 4C is a view showing a contact state between the groove of the rotor and a projection of a jig in the first embodiment.
Figure 5A:
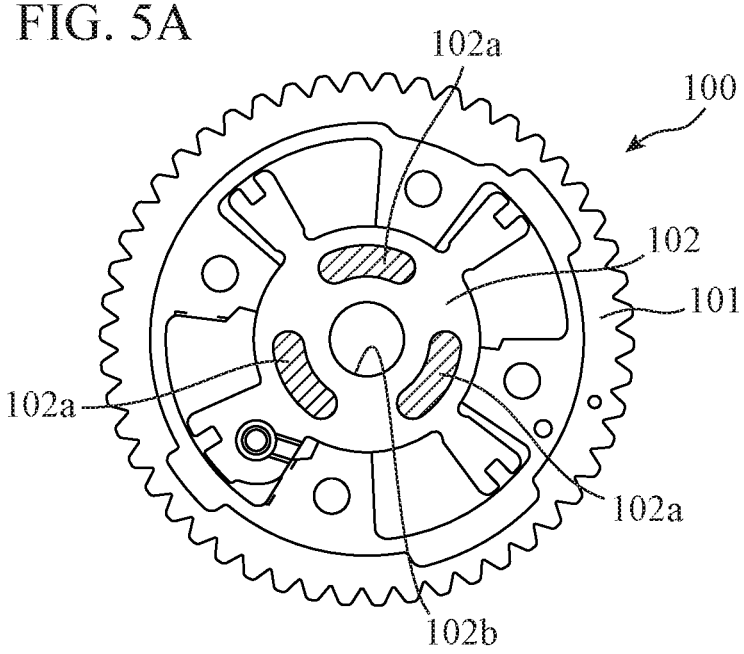
FIG. 5A is a view showing the inside of a conventional VVT device.
Figure 5B:
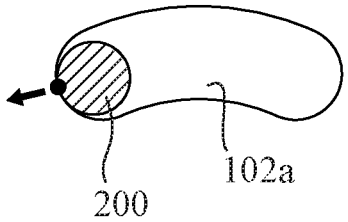
FIG. 5B is a view showing a contact state between a groove of a conventional rotor and a projection of a jig.

FIG. 4A is a view showing the inside of the VVT device 1, showing a state in which the cover 11, the spiral spring 12, and the spring holder 13 in FIG. 2 are removed. FIG. 4B is a view showing the groove 14*a* of the rotor 14. FIG. 4C is a view showing a contact state between the groove 14*a* and the projection 4*a* of the jig 4. FIG. 5A is a view showing the inside of a conventional VVT device 100 and shows the same state as FIG. 4A. FIG. 5B is a view showing a contact state between a groove 102*a* of a conventional rotor 102 and a projection 200 of a jig.

As shown in FIG. 4A, the rotor 14 includes a boss 14*c* and a vane 14*e* protruding from an outer periphery of the boss 14*c*, and a recess for fitting the spring holder 13 is formed at a center of the boss 14*c*. The groove 14*a* and the center hole 14*b* are formed on a bottom surface 14*c*-1 of the recess. In the groove 14*a* of the rotor 14, for example, the four grooves 14*a* are disposed at an equal angle about the axis of the rotor 14. By disposing the grooves 14*a* in this way, the rotor 14 is fastened to the camshaft 3 without tilt in the axial direction, and rotation balance of the VVT device 1 can be secured. Thereby, rotation efficiency of the VVT device 1 can be increased.

The recess of the boss 14*c* is a recess of a width across flat shape having inner walls 14*c*-2, 14*c*-2 faced in parallel. A main body of the spring holder 13 has an outer peripheral shape corresponding to this recess. By fitting the main body of the spring holder 13 into the recess of the boss 14*c*, a relative angle between the spring holder 13 and the rotor 14 can be positioned.

As shown in FIG. 4B, the groove 14*a* is a fan-shaped groove requiring an axial center of the rotor 14 in a plan view, and has an inner wall 14*a*-1 which is a flat surface in the rotation direction of the rotor 14. An inner wall 14*a*-2 is a cut surface for making it easier for a mold used for molding the groove 14*a* to escape.

The projection 4*a* of the jig 4 is a columnar member having a rectangular cross section and having a flat surface 4*a*-1.

On the other hand, in the conventional VVT device 100, like the VVT device 1, the rotor 102 is housed in a case 101, and the grooves 102*a* are formed around an axis of the rotor 102.

As shown in FIGS. 5A and 5B, the groove 102*a* is a long rounded groove whose both ends are rounded, and does not have the flat surface in the groove 14*a*.

The projection 200 of the conventional jig is a columnar member having a circular cross section.

As indicated by arrows in FIG. 4C, fastening torque generated when the center bolt 2 is tightened is received by the flat surface 4*a*-1 of the projection 4*a* and the inner wall 14*a*-1 of the groove 14*a*. Likewise, upon removal of the VVT device 1, loosening torque when the center bolt 2 is loosened is received by the flat surface 4*a*-1 of the projection 4*a* and the inner wall 14*a*-1 of the groove 14*a*.

Also in the conventional VVT device 100, as indicated by an arrow in FIG. 5B, fastening torque is received by the projection 200 of the jig and an inner wall of the groove 102*a*.

Likewise, upon removal of the VVT device 100 from a camshaft, loosening torque generated when a center bolt is loosened is received by the projection 200 of the jig and the inner wall of the groove 102*a*.

However, in the conventional VVT device 100, a load of the fastening torque is applied to a portion where the projection 200 and the inner wall of the groove 102*a* are in line contact with each other in a depth direction of the groove 102*a*.

Thus, there is a possibility that the groove 102*a* or the projection 200 of the jig is damaged by stress concentrated on a narrow contact area.

On the other hand, in the VVT device 1, a load of the fastening torque is applied to a portion where the flat surface

4*a*-1 and the inner wall 14*a*-1 are in surface contact with each other. Therefore, the stress concentration as in the conventional VVT device 100 does not occur, and damage to the projection 4*a* or the groove 14*a* resulting from this can be avoided.

Further, in the conventional VVT device 100, when securing the contact area between the groove 102*a* and the projection 200 of the jig, it is necessary to lengthen the projection 200 of the jig and deepen the groove 102*a*.

On the other hand, the VVT device 1 has a structure in which the flat surface 4*a*-1 and the inner wall 14*a*-1 come into surface contact and no stress concentrates, so that it is possible to make a depth of the groove 14*a* shallow.

Thus, for example, as shown in FIG. 3, an oil passage 14*d* can be provided in a lower portion of the groove 14*a*. The oil passage 14*d* communicates with an oil passage 3*b* provided in the camshaft 3, and oil is supplied or discharged to an oil pressure chamber in the case 10 through the oil passage 3*b* and the oil passage 14*d*.

In this manner, in the VVT device 1, since a space for forming the oil passage can be ensured also in the lower portion of the groove 14*a*, it is possible to reduce size and weight of the VVT device 1.

Note that, when an oil passage is formed at a position shifted from the lower portion of the groove 14*a*, the groove 14*a* may be a through hole. Thereby, weight of the rotor 14 can be reduced.

Figure 6:
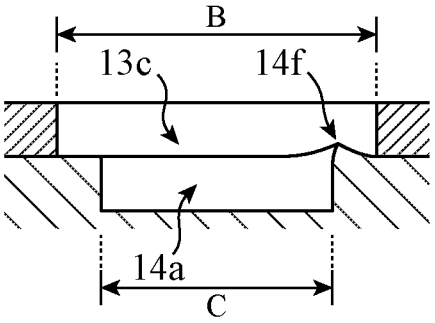
FIG. 6 is a sectional view showing the groove of the rotor and a long hole of a spring holder in the first embodiment.

FIG. 6 is a sectional view showing the groove 14*a* of the rotor 14 and the long hole 13*c* of the spring holder 13. As shown in FIG. 6, a circumferential dimension B of the long hole 13*c* is larger than a circumferential dimension C of the groove 14*a*. For example, when the jig 4 is slightly inclined at the time of assembling the VVT device 1 to the camshaft 3, there is a possibility that stress concentrates on a contact portion between the projection 4*a* and an opening peripheral edge of the groove 14*a*. When the opening peripheral edge of the groove 14*a* is plastically deformed due to the concentration of the stress, a minute raised portion 14*f* may be formed.

In the VVT device 1, as shown in FIG. 6, since the long hole 13*c* can avoid the raised portion 14*f*, the raised portion 14*f* does not prevent the spring holder 13 from being assembled to the rotor 14.

Figure 7A:
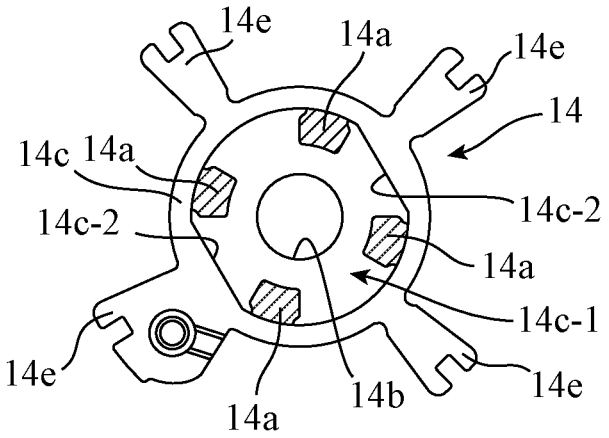
FIG. 7A is a front view showing the rotor in first embodiment.

As shown in FIG. 7A, an inner wall on a radially outer side of the groove 14*a* of the rotor 14 is continuous with the inner wall of the recess of the boss 14*c*. With such a configuration, it is possible to remove a mold for sinter molding, and the recess having the width across flat shape and the groove 14*a* can be formed by sinter molding.

Thereby, the rotor 14 can be formed by inexpensive sinter molding.

Figure 7B:
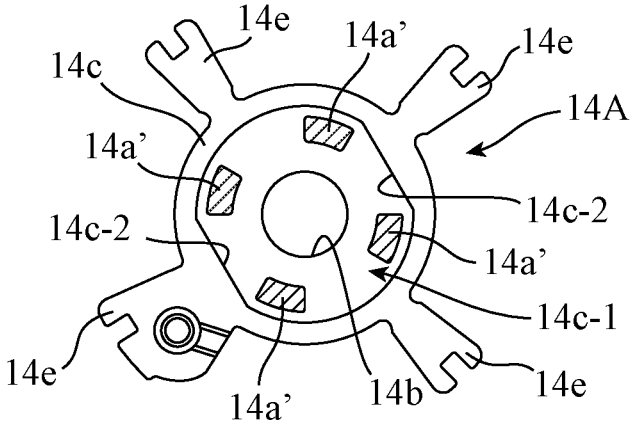
FIG. 7B is a front view showing another example of a rotor in the first embodiment.

In a rotor 14A shown in FIG. 7B, an inner wall on a radially outer side of a groove 14*a*' is not continuous with an inner wall of a recess of a boss 14*c*. In this configuration, when a distance between the inner wall on the radially outer side of the groove 14*a*' and the inner wall of the recess of the boss 14*c* is not separated equal to or more than an allowable range, sinter molding is damaged. Therefore, the rotor 14A may be less compact than the rotor 14. Further, from a viewpoint of design, when the distance between the inner wall on the radially outer side of the groove 14*a*' and the inner wall of the recess of the boss 14*c* cannot be separated equal to or more than the allowable range, the rotor 14A is formed by machining more expensively than the sinter molding.

In the above description, the configuration in which the projection 4*a* of the jig 4 and the groove 14*a* of the rotor 14 receive the fastening torque is shown, but in the VVT device 1 according to the first embodiment, a recess of a jig and a projection of the rotor may receive fastening torque.

Figure 8A:
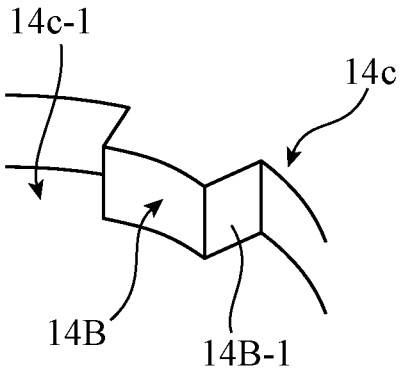
FIG. 8A is an enlarged perspective view showing a projection of the rotor in the first embodiment.
Figure 8B:
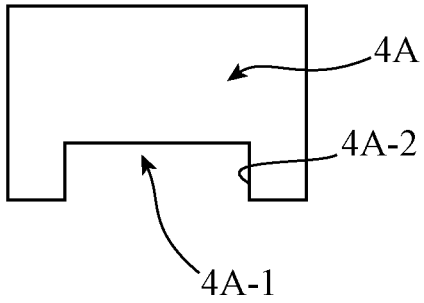
FIG. 8B is a side view showing a recess of a jig.

FIG. 8A is an enlarged perspective view showing a projection 14B of the rotor 14. As shown in FIG. 8A, the projection 14B is provided in the recess of the boss 14*c* of the rotor 14, and protrudes radially inward from the inner wall of the recess on the bottom surface 14*c*-1. The projection 14B has a flat surface 14B-1 in the rotation direction of the rotor 14. FIG. 8B is a side view showing a recess 4A-1 of a jig 4A. Like the jig 4 shown in FIG. 1, the jig 4A is a cylindrical member, and has the recess 4A-1 recessed in an axial direction at one end. The recess 4A-1 has an inner wall 4A-2 that is in surface contact with the flat surface 14B-1 of the projection 14B.

Figure 8C:
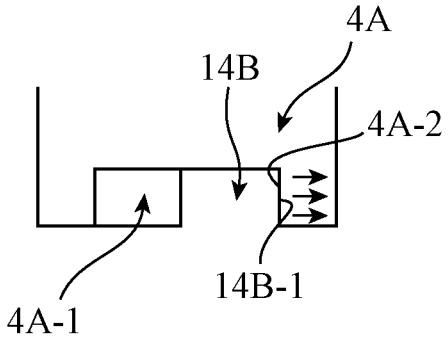
FIG. 8C is a view showing a contact state between the projection of the rotor and the recess of the jig in the first embodiment.

FIG. 8C is a view showing a contact state between the projection 14B of the rotor 14 and the recess 4A-1 of the jig 4A. As indicated by arrows in FIG. 8C, fastening torque generated when the center bolt 2 is tightened is received by the flat surface 14B-1 of the projection 14B and the inner wall 4A-2 of the recess 4A-1. Likewise, upon removal of the VVT device 1, loosening torque when the center bolt 2 is loosened can be received by the flat surface 14B-1 of the projection 14B and the inner wall 4A-2 of the recess 4A-1.

A load of the fastening torque is applied to a portion where the flat surface 14B-1 of the projection 14B and the inner wall 4A-2 of the recess 4A-1 are in surface contact. Therefore, the stress concentration as in the conventional VVT device 100 does not occur, and damage to the projection 14B or the recess 4A-1 resulting from this can be avoided.

A space for providing an oil passage is ensured at a lower portion of the projection 14B of the rotor 14 is ensured, so that the VVT device 1 can be reduced in size and weight.

Further, the projection 14B may be disposed at an equal angle around the axis of the rotor 14. With such a configuration, as in a case of the groove 14*a*, rotation balance of the VVT device 1 can be ensured, and rotation efficiency of the VVT device 1 can be increased.

As described above, the VVT device 1 according to the first embodiment includes the case 10, the rotor 14, and the groove 14*a* or the projection 14B. With this configuration, a load of fastening torque generated by tightening the center bolt 2 is applied to the portion where the rotor 14 and the jig 4 are in surface contact. Consequently, it is possible to suppress concentration of stress due to the fastening torque.

In the VVT device 1 according to the first embodiment, the torque receiving unit is disposed at an equal angle around the axis of the rotor 14. With such a configuration, rotation balance of the VVT device 1 can be ensured, and rotation efficiency of the VVT device 1 can be enhanced.

For example, three or more torque receiving units may be disposed at an equal angle around the axis of the rotor 14.

In the VVT device 1 according to the first embodiment, the torque receiving unit is a groove penetrating the rotor 14 in the axial direction. By configuring in this way, weight of the rotor 14 can be reduced.

In the VVT device 1 according to the first embodiment, the rotor 14 has the recess in the center of the boss 14*c*, the groove 14*a* is provided on the bottom surface 14*c*-1 of the recess, and the inner wall on the radially outer side is continuous with the inner wall of the recess. By configuring in this way, it becomes possible to remove a mold for sinter molding, and the recess having the width across flat shape and the groove 14*a* can be formed by inexpensive sinter molding.

Note that the present invention can modify arbitrary constituent elements in the embodiment or omit arbitrary constituent elements in the embodiment within the scope of the invention.

INDUSTRIAL APPLICABILITY

Since the VVT device according to the present invention can suppress concentration of a load of fastening torque generated by assembly using the bolt, it is suitable for a VVT device attached to a camshaft of an engine to control opening/closing timing of an intake valve or an exhaust valve.

REFERENCE SIGNS LIST

1, 100: VVT device, 2: center bolt, 2*a*: head, 2*b*: flange, 3: camshaft, 3*a*: female screw hole, 3*b*, 14*d*: oil passage, 4, 4A: jig, 4A-1: recess, 4A-2, 14*a*-1, 14*a*-2, 14*c*-2: inner wall, 4*a*, 14B, 200: projection, 4*a*-1, 14B-1: flat surface, 4*b*: through hole, 10, 101: case, 10*a*: chain sprocket, 11: cover, 12: spiral spring, 13: spring holder, 13*a*, 14*b*: center hole, 13*b*: bottom, 13*c*: long hole, 14, 14A, 102: rotor, 14*a*, 14*a*', 102*a*: groove, 14*c*: boss, 14*c*-1: bottom surface, 14*e*: vane, 14*f*: raised portion, and 15: housing

The invention claimed is:

1. A variable valve timing device comprising:

a case for rotating integrally with a crankshaft of an engine;

a rotor housed in the case, to be rotated integrally with a camshaft of the engine by fastening the rotor coaxially to the camshaft with a center bolt; and at least one torque receiving part provided around an axis of the rotor on an opposite side of the rotor to the camshaft, and having a flat surface intersecting a rotation direction of the rotor, wherein the at least one torque receiving part is a groove whose side wall includes the flat surface, the rotor has a recess in a center of a hub, the groove is provided on a bottom surface of the recess, the groove has an inner wall on a radially inner side of the groove and an inner wall on a radially outer side of the groove, and the inner walls face each other across the groove and intersect the side wall, and the inner wall on the radially outer side is continuous with and flush with an inner wall of the recess.

2. The variable valve timing device according to claim 1, wherein the at least one torque receiving part includes a plurality of torque receiving parts, and the plurality of torque receiving parts are equiangularly spaced around the axis of the rotor.

3. The variable valve timing device according to claim 1, wherein the groove penetrates the rotor in an axial direction of the rotor.

4. An assembly method of a variable valve timing device comprising:

attaching a jig to the at least one torque receiving part of the variable valve timing device according to claim 1; and fastening the rotor to the camshaft with the center bolt in a state in which the flat surface of the at least one torque receiving part and a part of the jig are in surface contact with each other in the rotation direction of the rotor.

* * * * *